US009489874B1

(12) United States Patent
Maynard

(10) Patent No.: US 9,489,874 B1
(45) Date of Patent: Nov. 8, 2016

(54) REPORTING OPEN SIGN

(71) Applicant: Jeremy Maynard, Richmond, KY (US)

(72) Inventor: Jeremy Maynard, Richmond, KY (US)

( * ) Notice: Subject to any disclaimer, the term of this patent is extended or adjusted under 35 U.S.C. 154(b) by 0 days.

(21) Appl. No.: 14/814,511

(22) Filed: Jul. 31, 2015

(51) Int. Cl.
*G08B 5/22* (2006.01)
*G09F 13/00* (2006.01)
*G08B 5/36* (2006.01)

(52) U.S. Cl.
CPC ..... *G09F 13/00* (2013.01); *G08B 5/36* (2013.01)

(58) Field of Classification Search
CPC ..... G09F 13/00; G08B 5/36
See application file for complete search history.

(56) References Cited

U.S. PATENT DOCUMENTS

2007/0205908 A1* 9/2007 Du ..... G08B 29/181 340/636.1
2010/0141153 A1* 6/2010 Recker ..... H05B 33/0803 315/149
2012/0262277 A1* 10/2012 Oliveira ..... H04L 67/18 340/8.1
2012/0266006 A1* 10/2012 Chen ..... G06F 11/2284 713/340
2016/0078800 A1* 3/2016 Ha ..... G09G 3/32 315/209 R

OTHER PUBLICATIONS

U.S. Appl. No. 13/734,976, filed Jan. 23, 2014, Hugo Fiennes.
U.S. Appl. No. 13/481,737, filed Nov. 29, 2012, Hugo Fiennes.
U.S. Appl. No. 12/358,240, filed Jul. 23, 2009, Joseph Chen.
U.S. Appl. No. 11/335,240, filed Sep. 20, 2007, Yaron Melman.
U.S. Appl. No. 13/087,273, filed Apr. 1, 2014, Alexadre H. Oliveira.
U.S. Appl. No. 13/763,006, filed Jun. 18, 2015, Wojciech Moczydlowski.

* cited by examiner

*Primary Examiner* — Nabil Syed
(74) *Attorney, Agent, or Firm* — Jeremy Maynard

(57) ABSTRACT

An open sign, including a body including a circuit in electrical communication with a lighting and an internet connector configured to send a store data, and a power supply in electrical communication with the lighting and the internet connector.

19 Claims, 9 Drawing Sheets

REPORTING OPEN SIGN

BACKGROUND

The present invention relates to providing real time data representing whether a store or shop is open for business.

Many stores display the open or closed status of the store via a sign. For example, the sign may display "closed" on one side and "open" on the opposite side. The sign may be positioned such that passersby may read and determine whether the store may be entered for business. More recently, many powered open signs comprise neon tubing shaped to spell the word "open." When lit, passersby know the store may be entered for business.

SUMMARY

Embodiments of the present invention include an open sign, including a body including a circuit in electrical communication with a lighting and an internet connector configured to send a store data, and a power supply in electrical communication with the lighting and the internet connector.

Further embodiments of the present invention include a method including providing an open sign, powering the open sign, sending a store data from the open sign, receiving the store data, and displaying the store data.

DETAILED DESCRIPTION

Figure 1:
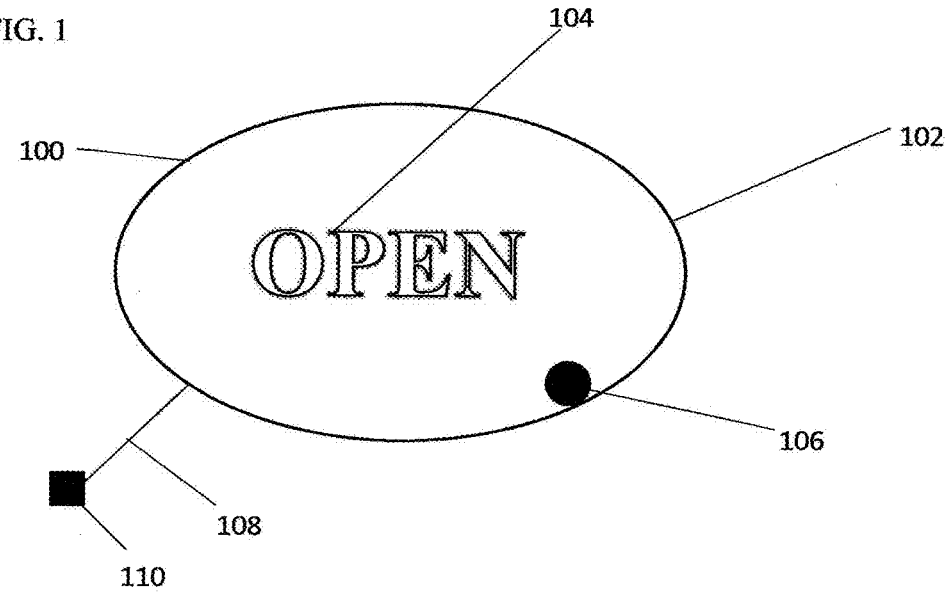
FIG. 1 illustrates a view of an embodiment of an open sign according to the principles of the present invention.

Several big box stores, such as Walmart are open 24/7. This allows the ultimate convenience for customers to shop at any time fitting for their schedule. On the other hand, most stores have a set closing time. Because the closing times of various stores differ, it becomes necessary for a shopper to determine whether the store is open before wasting traveling time to reach the store. Thus, many stores have begun to post their hours on the store window and online. However, sometimes unforeseen circumstances prevent the store from being open during standard hours. Therefore, many stores still use open signs to indicate whether the store has opened for the day.

These open signs are not synced with hours posted online. Therefore, a store may remain closed during normal operating hours due to sickness, inadvertence, or other unforeseen circumstances. Thus, the shopper may be led to believe that the store is open based on the online posting of the standard store hours. Once the shopper arrives at the store, the shopper may make the disappointing determination that the store was not yet open and that the shopper had wasted time traveling to the store. Thus, need exists to provide a system in which shoppers may be notified in real time whether the store is presently open and when the store will be opened if the store is closed during normal operating hours.

Furthermore, remaining closed during normal operating hours may damage the goodwill of a business due to inconvenience to the shopper. Thus, store owners may derive benefit from a system in which a message may be displayed explaining that the owner is sick and cannot open the store today. Receipt of this message by the shopper may mitigate any ill will caused by wasting time traveling to the store.

Furthermore, some store owners operate several stores or businesses. Therefore, a system that records when each store was opened would be beneficial for protecting the goodwill of each store. Thus, when a manager or other store representative has failed to open the store during normal business hours, the store owner may quickly arrange with another employee to open the store. Furthermore, the store owner may display a message to shoppers that the store will be open shortly. This may allow shoppers to remain in the vicinity for a short time, thus saving travel time away from and back to the store on another date.

For the purposes of the present application, the term "open" when used to reference the wording on an open sign includes the terms or phrases "open," "welcome," "thank you," "have a seat," and any other term in used to invite customers into a place of business, including colloquial terms and foreign language equivalents of these terms.

For the purposes of the present application, the term "open sign" means any sign positioned on, in, or near a store that is used to communicate to onlookers that the store is open for business at the present time the open sign is looked upon. An open sign may include a simple light that indicates that the store is open, such as a green light communicating to shoppers to enter the store. In some embodiments, the light may be positioned to indicate the status of the store. Thus, when the light is on, the store is indicated to be open and when the light is off, the store is indicated to be closed. This indication may be based on the position of the light relative to the store. As such, the light may be on, in, or near the store or a store sign.

For the purposes of the present application, the term "electrical communication" means that electricity flows between the elements in electrical communication.

For the purposes of the present invention, the term "electronic communication" means that a signal comprising an encoded data is transmitted between the elements in electronic communication. The signal may be electrical, electromagnetic radiation, sonic, or any other signal means of transmitting data.

For the purposes of the present application, the terms "and" and "or" are to be construed as conjunctively or disjunctively such that the broadest meaning is portrayed.

For the purposes of the present application, the term "power status" refers to the power status of the lighting, the openable path of the circuit, the on/off state of the switch, or any other power status that correlates to the power status of the lighting. In this manner, any of these power statuses may be used to approximate whether the store is presently open based on the power status of the open light.

The detailed description set forth below in connection with the appended drawings is intended as a description of various embodiments of the invention and is not intended to represent the only embodiments in which the invention may be practiced. The detailed description includes specific details for the purpose of providing a thorough understanding of the invention. However, it will be apparent to those skilled in the art that the invention may be practiced without these specific details. In some instances, well known structures and components are shown in block diagram form in order to avoid obscuring the concepts of the invention.

Aspects of the present invention are described herein with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a controller, a general purpose computer, a special purpose computer, or other programmable data processing apparatus to produce a machine, such that the instructions, which executed via the processor of the controller or other programmable data processing apparatus, create means for implementing the functions/acts specified in the flowchart and/or block diagram block or blocks.

These computer program instructions may also be stored in a computer readable medium that can direct the controller, the computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto the controller, a computer, other programmable data processing apparatus, or other devices to cause a series of operational steps to be performed on the controller, other programmable apparatus or other devices to produce a controller implemented process such that the instructions which execute on the controller or other programmable apparatus provide processes for implementing the functions/acts specified in the flowchart and/or block diagram block or blocks.

The following description is provided to enable any person skilled in the art to practice the various embodiments described herein. Various modifications to these embodiments will be readily apparent to those skilled in the art, and the generic principles defined herein may be applied to other embodiments. Thus, the claims are not intended to be limited to the embodiments shown herein, but are to be accorded the full scope consistent with each claim's language, wherein reference to an element in the singular is not intended to mean "one and only one" unless specifically so stated, but rather "one or more." All structural and functional equivalents to the elements of the various embodiments described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for."

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

As will be appreciated by one skilled in the art, aspects of the present invention may be embodied as a method, system, or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product on a computer-usable storage medium having computer-usable program code embodied in the medium.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. Aspects of the invention were chosen and described in order to best explain the principles of the invention and the practical application, and to enable others of ordinary skill in the art to understand the invention for various embodiments with various modifications as are suited to the particular use contemplated.

FIG. 1 illustrates a view of an embodiment of an open sign 100 according to the principles of the present invention. The open sign 100 may comprise a body 102. The body 102 may be any structure having a shape and sufficient strength to support the other elements of the open sign 100. For example, the body 102 may comprise metal, plastic, wood, etc. In some embodiments, the body 102 may be dark colored such that contrast is created between the body and a lighting 104 of the open sign 100. The open sign 100 may be hung in a window, hung outside, or may be positioned on a support. Thus the body 102 must have sufficient tensile and compression strength to support the elements of the open sign 100.

Furthermore, open sign 100 may comprise an electronic circuit (not illustrated in FIG. 1). This circuit may be attached to or contained entirely within the body 102. Furthermore, this circuit may power the lighting 104 and/or an internet connector 106. The circuit may also place the lighting 104 and the internet connector 106 in electrical communication with one another. Additionally, the lighting 104 and internet connector 106 may be in electronic communication.

The lighting 104 may comprise a neon tube light configured to spell the term "open." In other embodiments, "open" may be spelled with separate light emitting diodes (LEDs), on a liquid crystal display (LCD) screen, a cathode ray tube (CRT), on a flat panel screen or monitor, or any other electronic means of displaying the term "open." Further embodiments include use of a single light that to signal that a store is open. For example, a green light that resembles a traffic light may be used. The single light may not necessarily spell out any term, but may be positioned and configured such that a shopper recognizes the light to signify whether the store is open. Shoppers may readily recognize a light as signifying whether a store is open when the light is positioned in a store window or door or on the exterior of the store building at about window level. Furthermore, shoppers can recognize a light as signaling that a store is open when the light is positioned near a trademark of the store. As such, the light may be positioned on a billboard or exit ramp sign to signify that a corresponding store is open.

Internet connector 106 may comprise hardware such as a circuit configured as a wired or wireless internet adapter or other means of electronic communication. In some embodiments, this electronic communication may occur over internet connection. For example, the internet connector 106 may comprise an Ethernet jack for wired connection to a local router. In other embodiments, the internet connector 106 may comprise a wireless card. The wireless card may be connected to a local router, a local transmitter tower such as a radio tower, or a satellite. In some embodiments, the internet connector 106 may wirelessly connect directly to another computer or handheld device, such as a phone, watch, or tablet. In other embodiments, internet connector 106 may engage in electronic communication with another computer or device by infrared (IR) transmitter and receiver, Bluetooth connection, fiber optic connection, or any other connector for transferring electronic data. For example the internet connector 106 may send the store data over Bluetooth connection to a computer or other device. The computer may then upload the store data to the server via internet connection 106. Additional embodiments include an internet connector 106 that is configured to send the store data over Bluetooth, infrared communication, etc. directly to the server.

Internet connector 106 may transmit data over the internet connection via analog or digital signal, UDP or TCP, http, https, ssh, ftp, sftp, etc., or any other means to transfer electronic data. For example, the internet connector 106 may comprise data, such as a device id.

In some embodiments, a wire and plug 108 may be present as a power source 110 to connect the circuit of the open sign 100 such that the circuit and elements thereof (e.g. the lighting 104, the internet connector 106) may be powered. In other embodiments, power source 110 may comprise a battery, generator, or other portable source of electricity. Power source 110 may provide alternating current or direct current.

Figure 2:
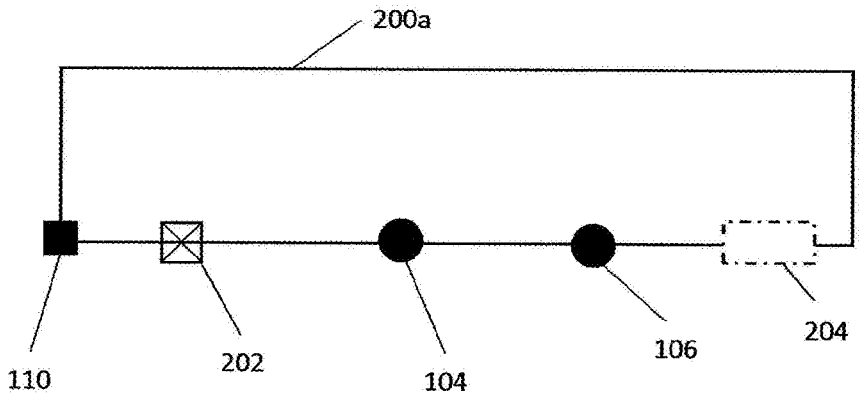
FIG. 2 illustrates a block-level diagram of an electronic circuit of the open sign of FIG. 1 according to the principles of the present invention.

FIG. 2 illustrates an electronic circuit of the open sign 100 of FIG. 1. For example, the circuit may place one or more of the power source 110, the lighting 104, a controller 204, and the internet connector 106 in electrical communication. Furthermore, the power source 110, the lighting 104, and the internet connector 106 may be in serial relationship on the circuit 200*a*. In some embodiments, the power source 110 may comprise the wire and plug 108 that may be simply unplugged such that the power is no longer connected. Therefore, the internet connector 106 may be powered when the lighting 104 is powered and may be unpowered when the lighting 104 is unpowered. In such embodiments, the internet connector 106 may send its device id, a "powered on" signal, and/or a store data to a server or other internet connected computer upon power on of the circuit. In this embodiment, power on of the circuit may be used as an approximation of powering the lighting 104 and the internet connector 106. Thus, powering the circuit may signify that the store is presently open for business. The internet connector 106 may send the powered on signal to the server at regular intervals, such as every minute, every five minutes, etc. Thus, the server can be configured to determine that the sign 100 is no longer plugged in when the internet connector 106 misses the powered on signal after the predetermined interval has passed. For example, the server has not received a powered on signal in five minutes when the internet connector 106 is configured to provide the powered on signal every minute. The server may request data of the internet connector 106 via poll, interrupt, or any other known method. Alternatively, the server can send a request to the internet connector 106. If the internet connector 106 does not respond, the server may determine that the sign 100 is not presently powered.

In other embodiments, a switch 202 may be placed in series relationship with the power supply 110, lighting 104, and internet connector 106. The switch 202 may open and/or close the circuit such that the wire and plug 108 does not necessarily need to be unplugged and replugged. Furthermore, the operation of the internet connector 106 may send its device id and/or a "power on" signal upon powering the internet connector 106. When the switch is deactivated, the internet connector 106 may send a "power off" signal to the server. The server or other connected computer may then determine that the internet connector 106 and the sign 100 is powered off. Alternatively, the server may determine that the sign 100 is not powered if the internet connector 106 misses providing the power on data on its regular interval or if the server requests a data from the internet connector 106 and receives no response.

In some embodiments, a controller 204 may be present on the circuit 200. Thus, the controller 204 may be in series with the power supply 110, lighting 104, internet connector 106, and switch 202, if present, on circuit 200*a*. The controller 204 may be used to store data, such as the device id for the sign 100 or a message provided by the store owner. The controller 204 may also make and/or respond to requests of the server via the internet connector 106. In some embodiments, the internet connector 106 and the controller 204 may be integrally formed.

Figure 3:
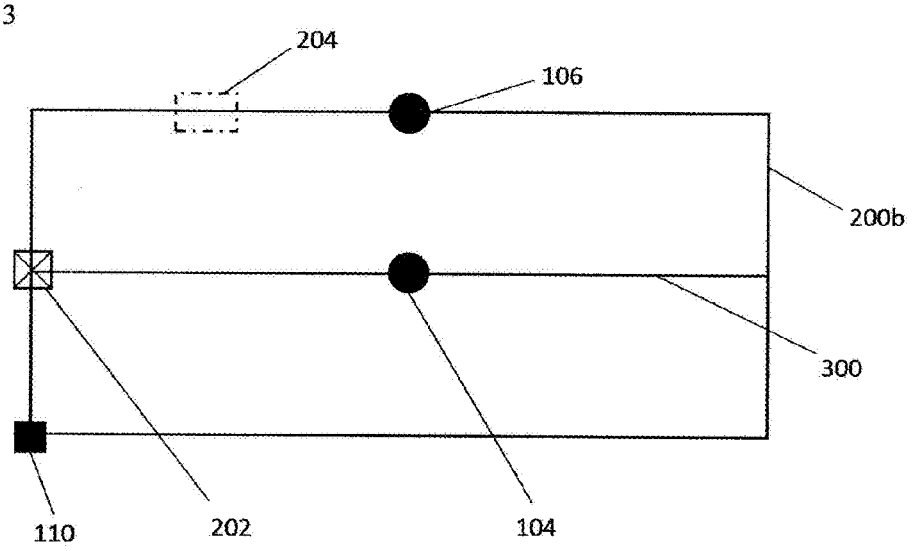
FIG. 3 illustrates a block-level diagram of an alternative electronic circuit of the sign of FIG. 1 according to the principles of the present invention.

FIG. 3 illustrates a block-level diagram of an alternative electronic circuit 200*b* of the sign 100 of FIG. 1 according to the principles of the present invention. Circuit may provide electrical communication between the power supply 110 and the lighting 104, the internet connector 106, the switch 202, if present, and the controller 204, if present.

However, circuit 200*b* may place the lighting 104 and the switch 202 in parallel relationship with the internet connector 106 and the controller 204, if present. Therefore, opening switch 202 may cut the power to the lighting 104 while the internet connector 106 remains powered. In this embodiment, the controller 204, if present and/or the internet connector 106 may be in electronic communication with the switch 202. The controller 204 may remain powered when the switch is off or otherwise positioned in a deactivated position. The switch 202 may notify the controller 204 and/or the internet connector 106 when the switch 202 is activated and/or deactivated. Furthermore, the controller 204 and/or the internet connector 106 may request or otherwise obtain the status of the switch 202 from the switch 202. The controller 204 and/or internet connector 106 may then provide the status to the server and/or other connected device after receipt of the status of the switch 202.

Figure 4A:
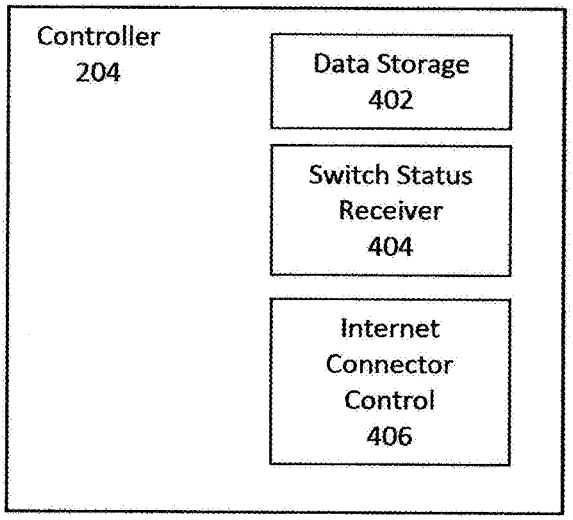
FIG. 4A illustrates a block-level diagram of a controller of the sign of FIG. 1 in accordance with the principles of the present invention.

FIG. 4A illustrates a block-level diagram of a controller 204 of the sign of FIG. 1 in accordance with the principles of the present invention. For example, the controller 204 may comprise a computer similar to the computer illustrated and described in FIG. 8. The controller 204 may be any device capable of sending and receiving electronic data over an interface. This interface may include a wired or wireless connection over which electronic communication may occur. For example, a microcontroller or a computer could be used. The controller 204 may also perform operations on and/or modify the data it receives such that the switch status receiver 404 and internet connector control 406 may be regulated.

The respective elements (402, 404, 406, etc.) of the controller 204 may be embodied on the controller 204. The respective controls may be embodied as hardware circuits or may be software embodiments wherein program code, such as java, C++, etc., manipulates the hardware of a general purpose hardware circuit. Software embodiments may be implemented as low-level code or even as high level code operating within an operating system, such as unix, bsd, Microsoft Windows, iOS, etc.

For example, switch status receiver 404 may comprise a software configured to receive the status from the switch 202. This status may be a Boolean, integer, string, character, character, or any other variable, flag, type, or signal representing the power status of the switch 202. In some embodiments, power status means the status differentiation between a powered state of the switch 202 and an unpowered state of the switch 202. The powered state may refer to the switch 202 positioned in the "on" position, wherein the switch 202 closes the circuit of the sign 100. Thus, the switch 202 in the powered on state may allow electrical current to flow through the circuit, which may thereby power one or more of the lighting 104, the internet connector 106, and the controller 204. The circuit may be powered by alternating or direct current. The switch 202 may open the circuit or a path of the circuit. In other embodiments, the switch 202 may open a portion of the circuit 200*b*. The portion of the circuit that the switch 202 may open may be referred to as the openable circuit path 300. The switch 202 may provide the status to the switch status receiver 404. Alternatively, the switch status receiver may obtain the status from the switch status receiver 404.

In other embodiments, the switch status receiver 404 may comprise a hardware configured to measure the current, directly or indirectly, in the circuit or in a portion of the circuit, such as the openable circuit path 300. For example, the switch status receiver 404 may comprise an ammeter on the openable circuit path 300. Of course, the switch status receiver 404 may comprise any hardware, software, or any combination of hardware and software used to determine whether the lighting is powered. For example, the switch status receiver 404 may comprise a circuit configured to provide the power status of the circuit or the power status of the switch upon the switch status receiver 404 receiving electricity. In some embodiments, the switch status receiver 404 may be integrally formed with the controller 204 and/or the internet connector 106.

Furthermore, the switch 202 may be positioned in an "off" position. This position may open the circuit or a portion thereof such that electricity does not flow through the circuit or the corresponding portion thereof, such as the openable path 300. Thus, the switch 202 may prevent electricity from powering one or more of the lighting 104, the internet connector 106, and the controller 204.

Controller 204 may comprise a processing unit (CPU), local memory, peripherals and interfaces, and a general purpose input/output (I/O) interface. The CPU may further comprise local storage. Local storage may be used to store variables, constants, etc. for complex calculations. Local memory may interface with the CPU via a memory interface. The memory interface may allow the CPU to store calculated values, variables, constants, or any other important electronic signal onto the physical local memory. The memory interface may include one or more direct memory access controllers. Of course, part or all of the local memory may be committed to program storage, in which data relevant to the operation of the program is stored. Program storage may also be organized into useful data structures such as a stack or heap. The peripherals and interface and the general purpose I/O interface may interface to external input or output devices. Examples of external input or output devices include any electronic device capable of sending or receiving an electronic signal such as keyboards, mice, printers, scanners, digital sensor, analog sensors, Ethernet, analog to digital converters, ADC, UART, USB, the internet connector 106, the lighting 104, the switch 202, etc.

Data storage 402, program storage, local memory, peripherals and interface, and general purpose I/O interface may be contained on the circuit board of the CPU. In other embodiments, any of these parts may be external to the CPU. Data storage 402 may store data such as the status of the switch 202 (activated and/or deactivated), the device id of the sign 100, a public internet protocol (IP) address of the sign 100, a local network IP address of the sign 100, a message, the store data 408, and/or any other data disclosed in the present application.

Data storage 402 may comprise any means of retaining electronic data in storage. Data storage 402 may comprise a circuit or hardware component, such as a hard drive, memory, compact disk, minidisk, DVD, magnetic tape, or other hardware unit configured for temporary or permanent storage of machine readable electronic data. In some embodiments, data storage 402 may comprise a software component in which the software component is configured to read, write, and/or edit the hardware of the data storage 402.

Figure 4B:
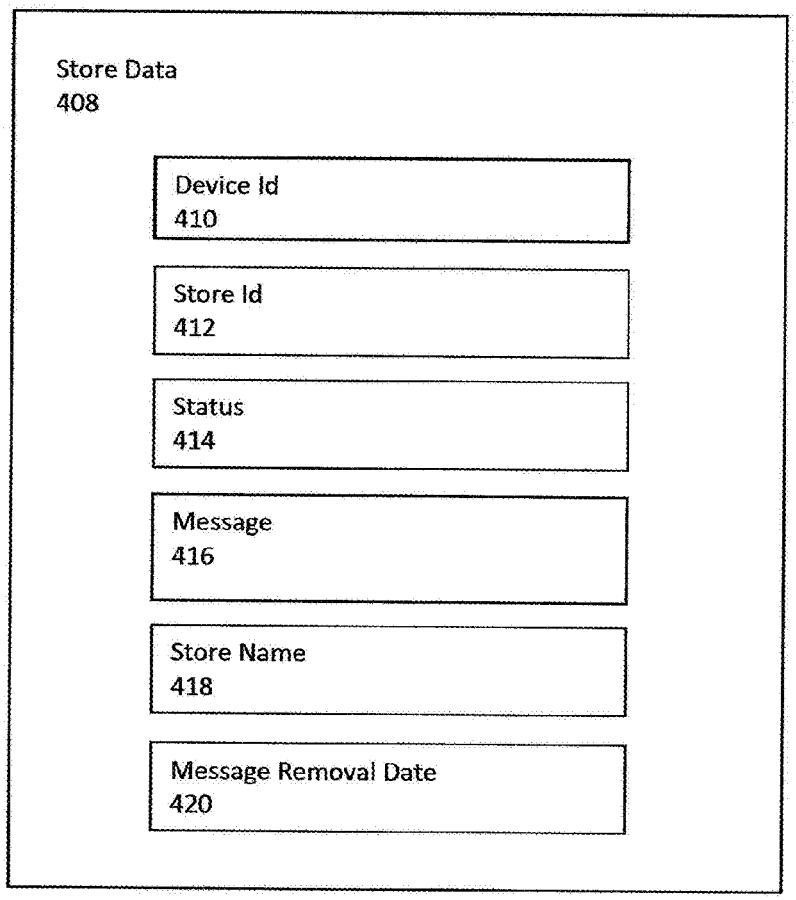
FIG. 4B illustrates a block-level diagram of a store data in accordance with the principles of the present invention.

FIG. 4B illustrates a block-level diagram of a store data 408 in accordance with the principles of the present invention. For example, the store data 408 may include one or more of a device Id 410, a store Id 412, a status 414, a message 416, a store name 418, and/or a message removal date 420. In other embodiments, the store data 408 may contain other information or less information. However, the store data 408 must include a store identifier and a status 414. The store identifier may comprise one or more of a device Id 410, a store Id 412, a store name 418, or any other data that distinguishes the identity of the store.

Transmission of the store data 408 may include concurrent transmission of at least the store identifier and status 414. In other embodiments, the store identifier, status 414, and other data, if present, may be transmitted independently. For the purposes of this invention, independent transmission of the store identifier and the status 414 is considered transmission of the store data 408.

The store data 408 may represent the set of associated data that correlates to one physical store. For example, the hardware id, IP address, or any other distinguishing data may be used correlated to the physical store such that a status and store identifier may be used together to indicate which physical store is open or closed. The device Id 410 may represent a hardware Id specific to one or more pieces of hardware on the sign 100. The store Id may represent the physical store in which the sign 100 is located or represents. The status 414 may represent the status of the store, such as "open" or "closed" or may represent the power status of the circuit of the sign 100 such as "power on" or "power off" or any other Boolean or variable that is used to distinguish between these two power states of the power status. The message 416 may comprise any message set by a store owner or device authenticated as a store representative. The message may be transmitted to and displayed on other computers and/or devices. The store name 418 may comprise the name of the physical store, such as McDonald's store #1001. The message removal date 420 may represent the date on which the corresponding message 416 is to be deleted or made non-accessible to other devices.

The store data 408 may comprise a store identifier and a status 414 such that the store data 408 represents whether a physical store is open for business. In turn, the status 414 may represent the power status (e.g. on/off) of the lighting 104. This power status is a useful approximation of whether the physical store is open for business, because an employee may turn the lighting 104 on when the store opens and off when the store closes. The store identifier may comprise the store Id 412, device Id 410, hardware Id, the store name 418, etc. However, multiple respective store identifiers may be unique to each physical location, hardware Id, etc. such that the store data 418 can be differentiated between multiple respective physical stores.

The controller 204 may receive and/or store the status of the switch 202. In some embodiments, "receive" means that the switch 202 transmits the power status of the switch 202 electronically to the controller 204. In other embodiments, "receive" means that the controller 204 may detect the power status of the switch 202 or any portion of the circuit in series with switch 202. The status of the switch 202 may be a Boolean or any variable representation of the powered status and the unpowered status of the switch 202. For example, as string "yes" or "no" could be used to represent the power status of the switch 202. The controller 204 may request the power status from the switch 202 or may detect current in series with the switch, such as using an ammeter. In some embodiments, the controller 204 receives the power status of the switch 202 upon state change of the switch 202 or lighting 104 power status.

Figure 5:
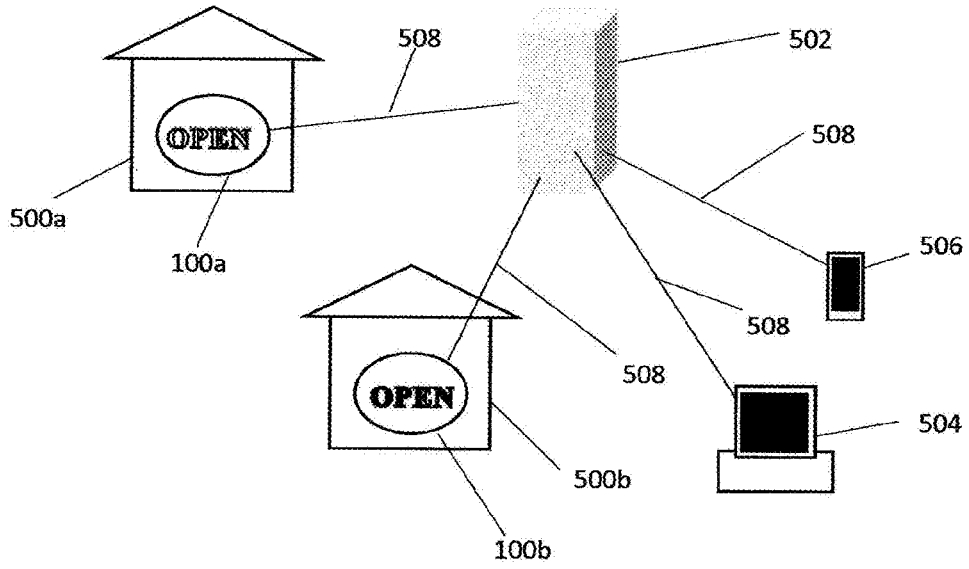
FIG. 5 illustrates a block-level diagram of the internet connection of multiple stores having multiple open signs, a server, a computer, and/or a handheld device in accordance with the principles of the present invention.

FIG. 5 illustrates a block-level diagram of the internet connection 508 of multiple stores 500 having multiple open signs 100, a server 502, a computer 504, and/or a handheld device 560 in accordance with the principles of the present invention. In some embodiments, other computers 504 or handheld devices 506 may be used to access store data 408 from the server 502. Accessing store data 408 means accessing the entire store data 408 or any component thereof as explained above, such as is illustrated in FIG. 4B. The computer 504, handheld device 506, open sign 100, and/or server 502 may be connected via internet connection 508. The internet connection 508 may be wired or wireless. Internet connection 508 may occur over an interface similar to the interface of the controller 204. Internet connection 508 may be analog or digital or may have a mix of analog and digital components. Internet connection 508 may be direct between two devices 100, 504, and/or 506, such as over FTP, SFTP, etc. Internet connection 508 may have a central server 502 that relays communication between devices, such as HTTP, HTTPS, SFTP, FTP, SSH, etc. Internet connection 508 may be continuous or may comprise a series of networks. For example, Internet connection 508 may include routers, modems, servers, cables, etc. In some embodiments, Internet connection 508 may be electronic, fiber optic, optical, wired, wireless, IR, Bluetooth, or any other means of transferring electronic data via transfer of a signal.

As depicted, store 500*a* may be open and thus sign 100*a* may be powered. Sign 100*a* may communicate a store data 408 over internet connection 508 via internet connector 106. The sign 100*a* may push the data to the server 502, which may then store the store data 408. In alternative embodiments, the server 502 may request the store data 408 from the sign 100*a*. The sign 100*a* may then provide the store data 408 to the server. In this example, the store data 408 may represent that the store is presently open because the sign 100*a* is powered. As another example, store 500*b* may be closed. Therefore, sign 100*b* may be dark. The sign 100*b* may send a store data 408 that represents that the store is not open to the server 502. The server 502 or other device may determine that the store data 408 relating to store 500*b* should represent that the store is closed if the sign 100*b* becomes unresponsive. Thus, the server 502 or other device may alter the store data 408 to represent the determined closed status of the store 500.

A computer 504 and/or handheld device 506 may be used to query the server 502 for the status of the store 500. This may be useful to determine whether the store 500 is open for business at the immediate moment. If the computer 504 or handheld device 506 can be authenticated to represent a store representative, then the computer 504 or handheld device 506 may alter the store data 408 such that a message may be contained. For example, the message may communicate that the store will open one hour late on the present date or a future date. The message may be stored on the server 502, such as within the store data 408 on the server 502. If the computer 504 or handheld device 506 is not authenticated as a store representative, the message may be displayed when a store data 408 is queried and obtained from the server 500.

The store data 408 may be stored entirely in the sign 100 or entirely in the server 502. In other embodiments, the store data 408 may be stored relationally over multiple devices and/or multiple locations. The computer 504 or handheld device 506 may request all or part of the store data 408 from the server 502 and/or the sign 100.

In some embodiments, internet connector 106 may engage in electronic communication with another computer 504 or device 506 by infrared (IR) transmitter and receiver, Bluetooth connection, fiber optic connection, or any other connector for transferring electronic data. For example the internet connector 106 may send the store data 408 over Bluetooth connection to a computer 504 or other device 506.

The computer 504 may then upload the store data 408 to the server via internet connection 106. Additional embodiments include an internet connector 106 that is configured to send the store data 408 over Bluetooth, infrared communication, etc. directly to the server 502.

Figure 6:
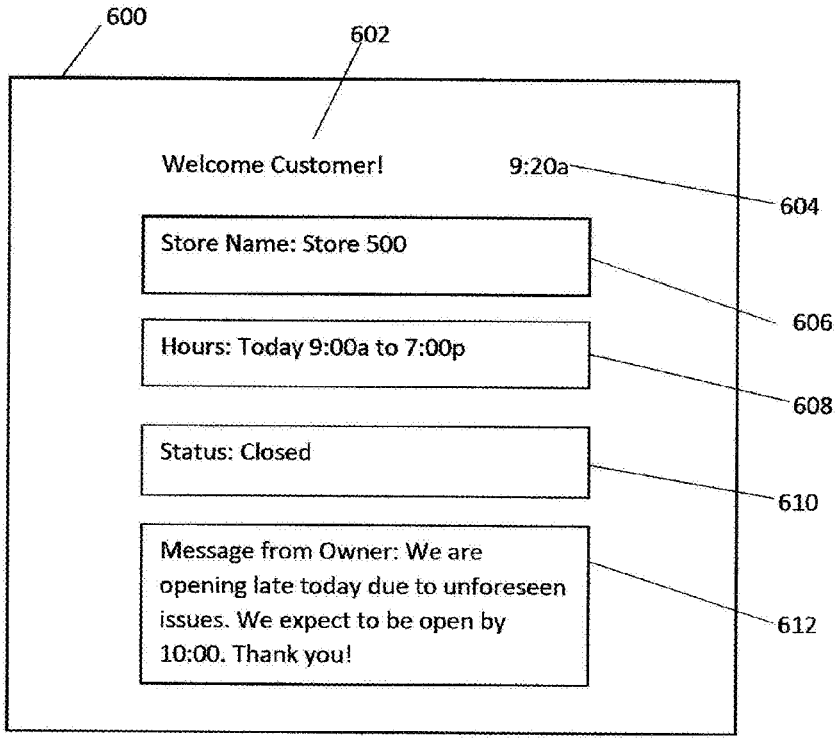
FIG. 6 illustrates a block-level diagram of an example screenshot displayed when accessing the store data of FIG. 4B according to the principles of the present invention.

FIG. 6 illustrates a block-level diagram of an example screenshot 600 displayed by a computer 504 and/or handheld device 506 when accessing the store data 408 of FIG. 4B according to the principles of the present invention. In some embodiments, the handheld device 506 is similar to the computer 504 as described with regard to FIG. 8. In other embodiments, the handheld device 506 is similar to the controller 204. A user type 602 may be displayed, for example in the greeting 602. The user type may indicate that the computer 504 or device 506 is accessing the store data 408 as a customer or as a store representative. The customer may be limited in that messages 416 may not necessarily be edited by the customer. The store representative may create, modify, and delete messages 416 as well as set the message removal date 420. The current time 604 may be displayed. The store name 606 may be displayed from the store data 408. The operating hours 608 may be displayed to represent the standard operating hours of the business. The present status of the store 610 may be displayed. The present status of the store 610 may be obtained or determined from the store identifier and the status 414 of the store data 408. The message from the owner 612 may be displayed on screen.

Figure 7:
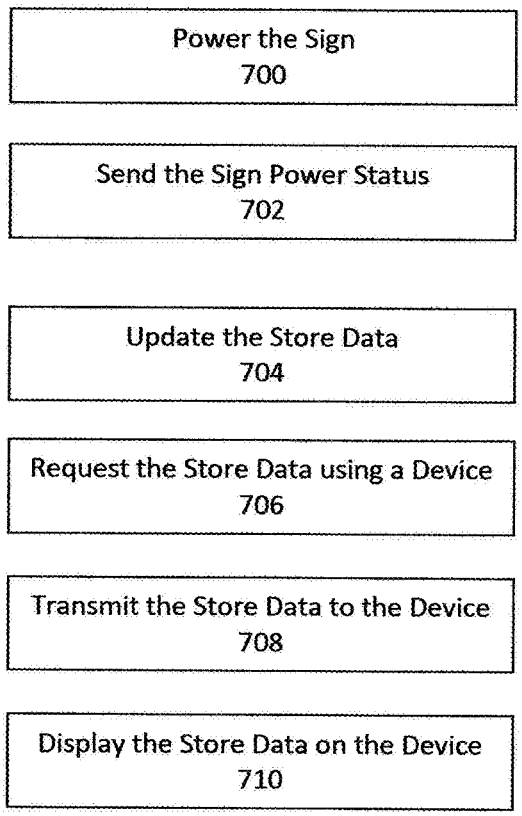
FIG. 7 illustrates a block-level diagram of transmitting a store data according to the principles of the present invention.

FIG. 7 illustrates a block-level diagram of transmitting the store data 408 according to the principles of the present invention. In step 700, the sign is powered. Powering may occur by plugging the sign 100 into an electrical socket. Alternatively, powering may occur by activating the switch 202. In step 702, the status 414 of the sign 100 may be sent to the server 502 or other device 504, 506. Alternatively, the server 502 or other device 504, 506 may request the status 414 from the sign 100 in step 702. The power status of the sign 100 may be sent directly to the server 502, to the computer 504, or to the handheld device 506. In step 704, the store data 408 may be updated. Thus, the server 502 may update the status 414 or other information stored in the store data 408. Alternatively, another device 504, 506 or multiple devices may be used to update the store data 408 where ever the store data 408 is stored. In step 706, the device 504, 506 may be used to request the store data 408. This request may be made to the server 502 or any other device 504, 506 that stores the store data 408. In step 708, the store data 408, or any portion thereof, can be transmitted to the requesting device 504, 506. In some embodiments, the store data 408 is transmitted from the server 502 to the requesting device 504, 506. In step 710, the store data may be displayed on the requesting device. This may occur by screen, physical printing, or any other display means. In some embodiments, the store data 408 may be transmitted directly from the sign 100 to the computer 504 or handheld device 506. Transmission of the store data 408 may occur via http, https, ssh, tcp, ftp, smtp, sms, text etc., email, browser, or other client, etc., whether the transmission is to the server 502 or the computer 504 or handheld device 506. Furthermore, this transmission may occur over a phone call or by text message. Additionally, store data 408 may be transmitted to the server 502, computer 504, or handheld device 506 before a corresponding request is made using a device. Thus, step 706 is not required in every embodiment.

Figure 8:
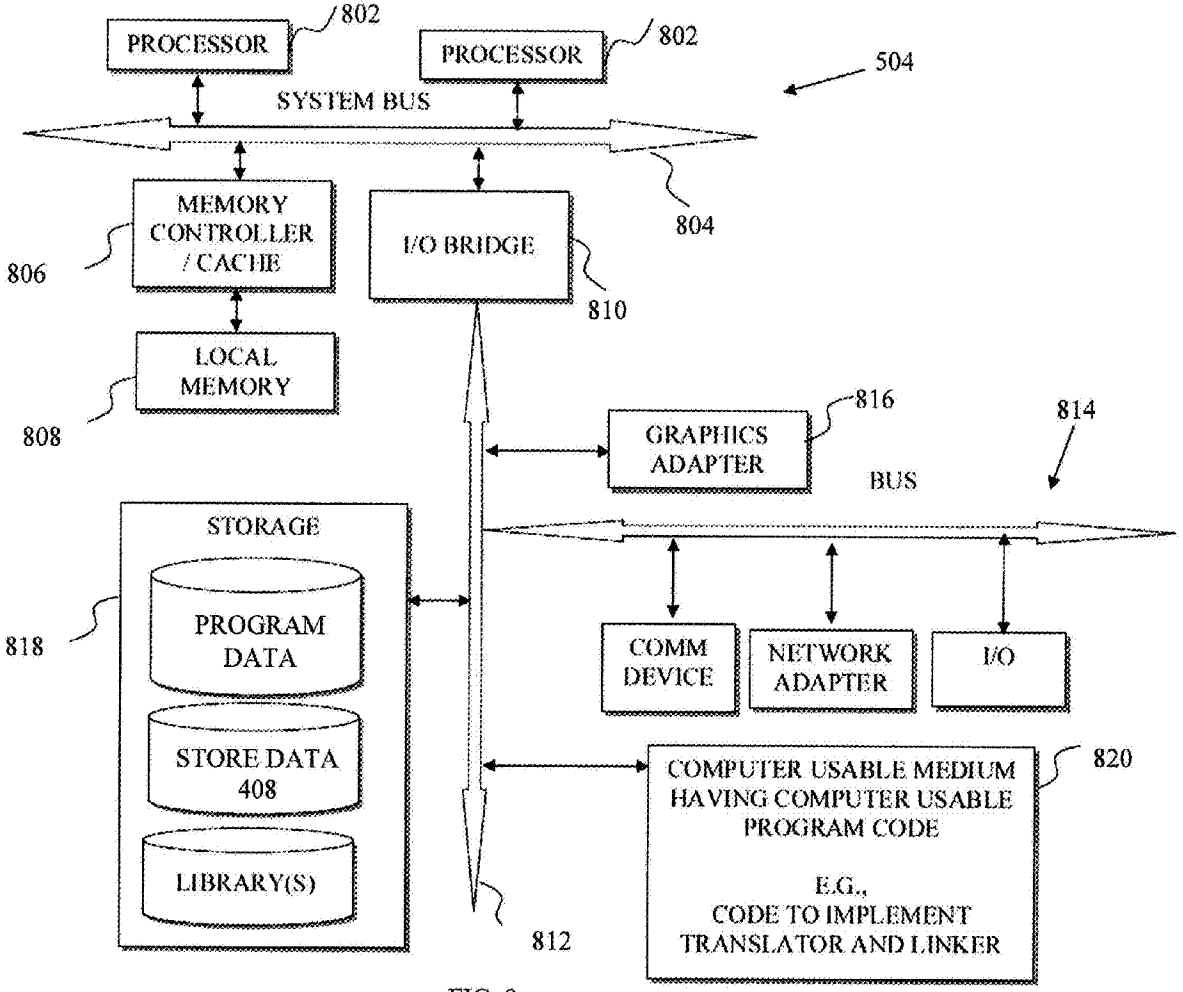
FIG. 8 illustrates a block-level diagram of the computer of FIG. 5 in accordance with the principles of the present invention.

FIG. 8 illustrates a block-level diagram of the computer 504 of FIG. 5 in accordance with the principles of the present invention. In some embodiments, the computer 504 may comprise a device as described with regard to FIG. 8. The computer 504 may have a computer readable storage medium for implementing functions comprising aspects of the method detailed above. Computer 504 may comprise a symmetric multiprocessor (SMP) system or other configuration including a plurality of processors 802 connected to system bus 804. Alternatively, a single processor 802 may be employed. Also connected to system bus 804 is memory controller/cache 806, which provides an interface to local memory 808. An I/O bridge 810 is connected to the system bus 804 and provides an interface to an I/O bus 812. The I/O bus 812 may be utilized to support one or more buses and corresponding devices, such as bus bridges 814, input output devices (I/O devices), storage, network adapters, etc. Thus, a network adapter may be coupled to the system to enable the data processing system to become coupled to other data processing systems or remote printers or storage devices through intervening private or public networks.

Also connected to the I/O bus 812 may be devices such as a graphics adapter 816, storage 818 and a computer usable storage medium 820 having computer usable program code embodied thereon. The computer usable program code may be executed, e.g., by the processor(s) to implement any aspect of the present invention, for example, to implement any aspect of any of the methods, processes and/or system components illustrated in FIGS. 1-7. For instance, the computer usable program code can be utilized to implement any or all aspects of transmitting a store data 408 as in FIG. 7. Moreover, the computer usable program code may be implemented in the local memory 808 or other suitable storage medium.

The storage 818 may store resources useful in implementing the features previously described. For instance, the storage 818 can store the computer instructions which, when executed, implement the functions of transmitting a store data, as in FIG. 7, which may comprise program data for communicating with the server 502, other devices 504, 506, the store data 408, as well as any useful libraries for manipulating the storage of this data.

What is claimed is:

1. An open sign, comprising:

a lighting in electrical communication with an internet connector via a circuit configured to send a store data, and a power supply in electrical communication with the lighting and the internet connector via the circuit, wherein the open sign is configured to generate a store data comprising a status corresponding to a detected power status of the lighting, wherein the status corresponds to an open status of a store when the detected power status indicates that the lighting is powered, wherein the status corresponds to a closed status of the store when the detected power status indicates that the lighting is unpowered, and wherein the internet connector is configured to send the store data to a server over an internet connection.

2. The open sign of claim 1, wherein the open sign is configured to generate the status by detecting the power status by a switch status receiver configured to detect whether the lighting is powered.

3. The open sign of claim 1, wherein the internet connector is configured to send the store data comprising an open status at predetermined intervals while the lighting is detected as powered.

4. The open sign of claim 2, further comprising a switch in series circuit relationship with the lighting, wherein the switch is configured to alter the power status of the lighting.

5. The open sign of claim 4, wherein the lighting is in a parallel circuit relationship with the internet connector.

6. The open sign of claim 1, wherein the store data further comprises a store identifier.

7. The open sign of claim 1, wherein the internet connector is configured to send the store data comprising the status corresponding to an open status of the corresponding store upon detection of powering the lighting.

8. The open sign of claim 1, wherein the internet connector is configured to send the store data comprising the status corresponding to an open status of the corresponding store subsequent to detection of powering the lighting.

9. The open sign of claim 1, wherein the internet connector is configured to send the store data comprising the status corresponding to a closed status of the corresponding store upon detection of powering off the lighting.

10. The open sign of claim 1, wherein the internet connector is configured to send the store data comprising the status corresponding to a closed status of the corresponding store subsequent to detection of powering off the lighting.

11. The open sign of claim 1, wherein the open sign is configured to generate a status corresponding to the detected power status by detecting whether the lighting is being powered.

12. The open sign of claim 1, wherein the open sign is configured to generate a status corresponding to the detected power status by detecting whether the lighting is lit.

13. A store data storage system, comprising:

a server configured to receive a store data by an open sign associated with a corresponding store, wherein the open sign is configured to send the store data to the server over an internet connection, wherein the store data comprises a store identifier corresponding to the store and a status corresponding to a detected power status of a lighting of the open sign, wherein the status corresponds to an open status of the store when the detected power status indicates that the lighting is powered, and wherein the status corresponds to a closed status of the store when the detected power status indicates that the lighting is unpowered.

14. The store data storage device of claim 13, wherein the server is further configured to store the store data relationally such that the store data can be queried using the store identifier as an index.

15. The store data storage device of claim 14, wherein the server is further configured to query the stored store data by selecting the store identifier of an individual stored store data corresponding to a predetermined store identifier and to return the corresponding open status of the selected individual stored store data.

16. The store data storage device of claim 13, wherein the server is configured to request the status corresponding to the detected power status of the lighting from the open sign.

17. A method of providing a store data, comprising:

generating a store data comprising a status corresponding to a store status of a store, wherein generating the store data comprises:

detecting a power status of a lighting of an open sign, wherein the power status corresponds to one of a powered status and an unpowered status of the lighting, setting the store status to correspond to an open store status when the detected power status is powered, setting the store status to correspond to a closed store status when the detected power status is unpowered, and wherein the open sign is configured to send the store data to a server over an internet connection.

18. The method of claim 17, wherein generating the store data further comprises setting a store identifier corresponding to the store.

19. The method of claim 17, further comprising:

altering the power status of the lighting by at least one of a switch and an electrical plug.

* * * * *